US006796361B1

(12) United States Patent
Campbell et al.

(10) Patent No.: US 6,796,361 B1
(45) Date of Patent: Sep. 28, 2004

(54) HURRICANE I-POST

(75) Inventors: James K. Campbell, Sandwich, IL (US); Thomas F. Brand, Yorkville, IL (US)

(73) Assignee: General American Door Company, Montgomery, IL (US)

( * ) Notice: Subject to any disclaimer, the term of this patent is extended or adjusted under 35 U.S.C. 154(b) by 0 days.

(21) Appl. No.: 10/397,442

(22) Filed: Mar. 27, 2003

(51) Int. Cl.[7] ..... E05D 15/00

(52) U.S. Cl. ..... 160/209; 160/201; 52/127.2; 52/167.3

(58) Field of Search ..... 160/181, 188, 160/189, 133, 201, 209, 207, 233, 234; 49/199; 52/127.2, 167.3

(56) References Cited

U.S. PATENT DOCUMENTS 3,443,625 A * 5/1969 Moser et al. ..... 160/181
5,383,509 A * 1/1995 Gaffney et al. ..... 160/209
5,445,207 A * 8/1995 Romanelli et al. ..... 160/209
5,620,038 A * 4/1997 DeCola et al. ..... 160/209
5,732,758 A * 3/1998 Marko ..... 160/201
5,819,834 A * 10/1998 Wedekind ..... 160/209
5,967,216 A * 10/1999 Mancini ..... 160/209
6,082,431 A * 7/2000 Decola ..... 160/209
6,385,916 B1 * 5/2002 Marko ..... 52/127.2

* cited by examiner

*Primary Examiner*—Bruce A. Lev
(74) *Attorney, Agent, or Firm*—Davis Chin

(57) ABSTRACT

A garage door reinforcement arrangement for supporting and anchoring a garage door to a garage door opening includes an I-post beam assembly, a top mounting bracket, a floor plate, and a plurality of cable assemblies. The top mounting bracket is used to secure the top end of the I-post beam against vertical movement. The floor plate is used for securing the bottom end of the I-post against vertical movement. The plurality of cable assemblies are disposed at different vertical positions of the I-post beam for securing the beam immediately adjacent to the garage door so that the garage door is allowed to flex slightly as wind loads are transferred to the beam.

13 Claims, 5 Drawing Sheets

HURRICANE I-POST

BACKGROUND OF THE INVENTION

1. Field of the Invention

This invention relates generally to storm or hurricane reinforcement devices for overhead garage doors. More particularly, it relates to a garage door reinforcement arrangement of a unique construction for supporting and anchoring a garage door from being detached during hurricane or high wind conditions.

2. Description of the Prior Art

As is generally well known in the art, multi-panel garage doors are used typically in the construction of residential dwellings and are made of lightweight material such as painted galvanized steel, high density polyethylene, or fiberglass. However, these multi-panel garage doors are susceptible to a particular problem when they are located in geographical areas which experience high velocity winds, such as in an intense storm or hurricane. Under such high velocity winds, the panels of the garage door will be subjected to a continued flexing so as to cause them to separate from the guide tracks and eventually resulting in the garage door being blown out from the door opening. As a result, the residential dwellings will become further damaged by high velocity winds and may possibly be completely destroyed.

In view of this, there have been proposed heretofore in the prior art various types of constructions or arrangements for reinforcing and/or anchoring the garage door to protect against damage from high velocity winds. The prior art appears to be best exemplified in the following U.S. Letters Patent which were developed in a search in the United States Patent and Trademark Office directed to the subject matter of this application:

| | |
|---|---|
| 5,620,038 | 6,161,606 |
| 5,964,269 | 6,385,916 |
| 6,028,431 | |

In U.S. Pat. No. 5,620,038 issued to S. M. DeCola et al. on Apr. 15, 1977, there is disclosed a garage door bracing arrangement for reinforcing the entire vertical extent of a multi-panel garage door against high velocity winds. The bracing arrangement includes a plurality of door-stiffening column members that are installed between associated upper mounting brackets above the garage opening and lower mounting brackets affixed to the garage floor. The bracing arrangement also includes deflection brackets which attach the door panel hinge joints to the column members so that the entire vertical extent of the garage door is securely braced against high velocity winds.

In U.S. Pat. Nos. 5,694,269 and 6,082,431 issued to S. M. DeCola on Oct. 12, 1999, and Jul. 4, 2000, respectively, there is described a garage door bracing arrangement which consists of a plurality of vertically extending door-stiffening column members which are pivotally attached to upper mounting brackets affixed to garage building structures directly above the garage door opening. Lower mounting brackets are affixed to second ends of the column members and are anchored to the floor directly beneath the upper mounting brackets. The door-stiffening column members are configured as generally hollow, rigid, telescoping sections having longitudinal channels which retain fasteners that project from sides of the telescoping sections. Deflection brackets are used to secure the door-stiffening column members to door panel hinge joints.

U.S. Pat. No. 6,161,606 issued to D. K. Wegner on Dec. 19, 2000, teaches a reinforcing strut for garage doors which extends the full width of the door across the inside rear face of the door. The reinforcing strut includes substantially straight parallel and widely spaced legs which are joined by a large-radius curved section.

Finally, U.S. Pat. No. 6,385,916 issued to W. Marko on May 14, 2002, shows a building aperture cover reinforcing device which includes an elongated support post having a first end spaced apart from a second end by a middle portion. An engagement pin extends from each end of the post. In use, the first end engagement pin is held in place by a bracket assembly attached to the building aperture upper boundary wall, and the second end engagement pin is held in place by a floor-mounted anchor plate. The middle portion of the support post is secured to the aperture cover by cooperative interaction between linking hooks mounted along the middle portion and corresponding linking plates mounted on the aperture cover.

However, none of the prior art uncovered in the search and as discussed above disclosed a garage door reinforcement arrangement for supporting and anchoring a garage door to a garage door opening like that of the present invention. The garage door reinforcement arrangement includes an I-post beam assembly, a top mounting bracket, and a floor plate. The beam assembly includes an I-post beam having a top end and a bottom end, a top link secured adjacent to the top end, and a bottom catch plate secured adjacent to the bottom end. The top link of the beam is operatively engaged with the top mounting bracket, and the bottom plate of the beam is operatively engaged with the floor plate. A plurality of cable assemblies are placed around the beam at various vertical positions and are secured to horizontal struts associated with the garage door.

SUMMARY OF THE INVENTION

Accordingly, it is a general object of the present invention to provide a garage door reinforcement arrangement for supporting and anchoring a garage door which is relatively simple and economical to manufacture and assemble, but yet overcomes the disadvantages of the prior art reinforcing arrangements for garage doors.

It is an object of the present invention to provide a garage door reinforcement arrangement which includes an I-post beam assembly that is simple to engage and disengage without the need of tools.

It is another object of the present invention to provide a garage door reinforcement arrangement which is made of relatively lightweight material so as to be easily transported by a single individual person.

It is still another object of the present invention to provide a garage door reinforcement arrangement for supporting and anchoring a garage door which includes an I-post beam assembly, a top mounting bracket, a floor plate, and a plurality of cable assemblies.

In accordance with these aims and objectives, there is provided in the present invention a garage door reinforcement arrangement for supporting and anchoring a garage door to a garage door opening. The reinforcement arrangement includes an I-post beam assembly, a top mounting bracket, a floor plate, and a plurality of cable assemblies. The I-post beam assembly consists of an I-post beam having a top end and a bottom end, a top link secured adjacent to the top end, and a bottom catch plate secured adjacent to the bottom end. The top link includes a distal end wall piece and the bottom catch plate has a downwardly-extending tooth portion. The tooth portion is formed with a central through-hole for receiving a threaded pin therein. The top mounting bracket is mounted centrally on a wall surface of a garage building structure between side edges of the garage door opening. The top mounting bracket consists of a base member, an intermediate member secured to the base member, an extending portion secured to the intermediate member, and a protruding portion secured to the base member and aligned below a tip end of the extending portion.

The tip end of the extending portion is spaced outwardly from the base member so as to form a recess therebetween. The distal end wall piece of the top link is received in the recess and retained by the protruding portion of the top mounting bracket. The floor plate is anchored to a garage floor and is aligned directly beneath the top mounting bracket. The floor plate includes a retaining slot for receiving and retaining the tooth portion with the threaded pin of the bottom catch plate. The plurality of cable assemblies are disposed at different vertical positions of the I-post beam and are securely mounted to corresponding horizontal strut members of the garage door.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Reference is now made in detail to the specific embodiment of the present invention that illustrates the best mode presently contemplated by the inventors for practicing the invention. It should be understood that the description of the best mode is merely illustrative and that it should not be taken in a limiting sense.

Figure 1:
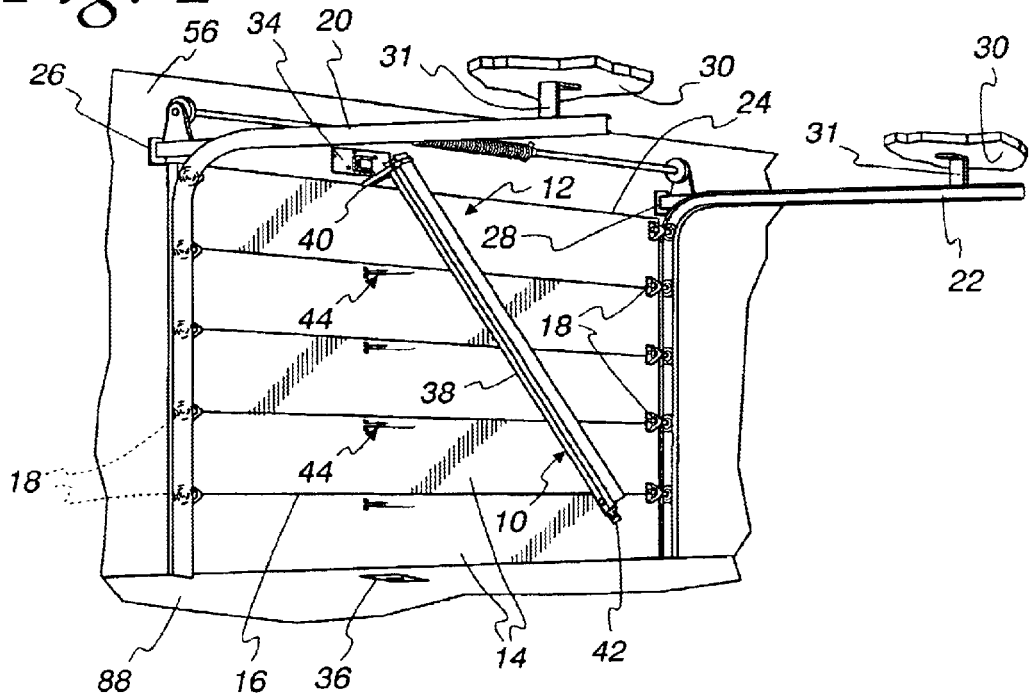
FIG. 1 is a pictorial view of a garage door reinforcement arrangement of the present invention, illustrated in a partially-engaged position with a conventional multi-panel garage door.

Referring now in detail to the various views of the drawings, there is shown in FIG. 1 a pictorial view of a garage door reinforcement arrangement 10, constructed in accordance with the principles of the present invention, of a new and novel configuration for supporting and anchoring a conventional multi-panel residential garage door 12 from being detached during high velocity wind conditions, such as an intense storm or hurricane. The garage door 12 includes a plurality of panels 14 each being made of a lightweight material such as galvanized steel or fiberglass. The panels 14 are hinged together at hinge joints 16 which are equipped with side rollers 18 for traveling in a pair of guide tracks 20 and 22 disposed on opposite edges of the garage door opening 24. The guide tracks 20, 22 are typically anchored to wall portions 26, 28 of the garage adjacent to the door opening 24 and are attached to the ceiling 30 by way of a pair of brackets 31. The garage door may be moved up and down between open and closed positions in a known manner, such as by an automatic garage door opener mounted to the ceiling 30 and attached to the topmost one of the door panels 14.

Figure 11:
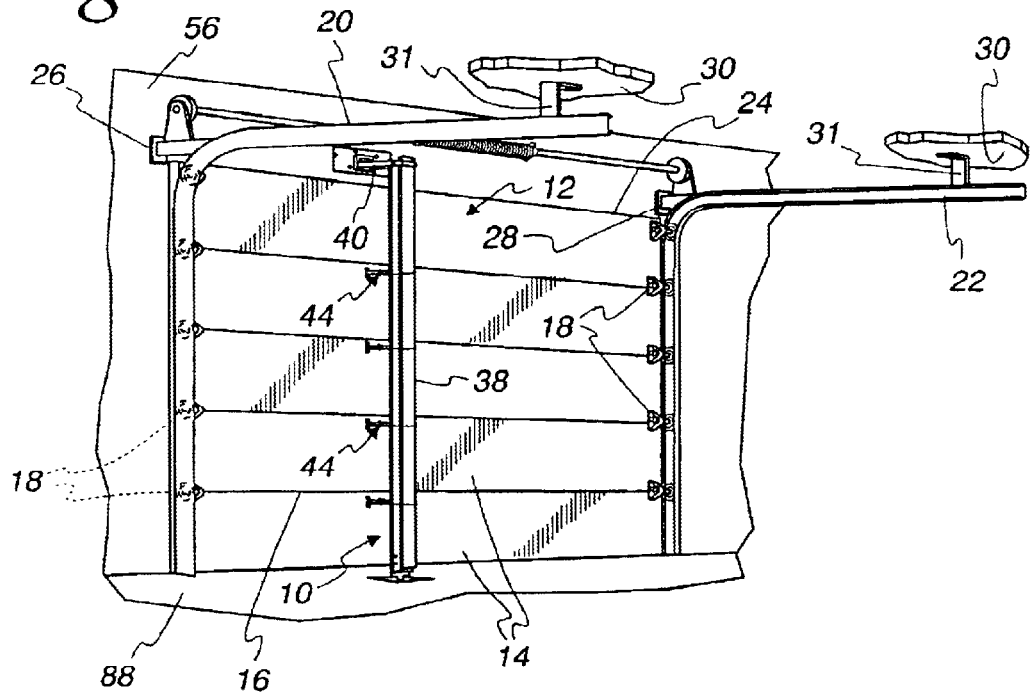
FIG. 11 is a pictorial view of the garage door reinforcement arrangement of the present invention, illustrated in a fully engaged position.

The garage door reinforcement arrangement 10 of the present invention is shown generally in FIGS. 1 and 11 and is depicted in detail in FIGS. 2 through 10. The reinforcement arrangement 10 is comprised of an I-post beam assembly 32, a top mounting bracket 34, and a floor plate 36. The I-post beam assembly 32 includes an I-post beam 38 having a top end and a bottom end, a top link 40 secured adjacent to the top end of the beam 38, and a bottom catch plate 42 secured adjacent to the bottom end thereof. During use, the top link 40 of the beam assembly 32 is operatively engaged with the top mounting bracket 34, and the bottom catch plate 42 of the beam assembly 32 is operatively engaged with the floor plate 36. A plurality of cable assemblies 44 are placed around the beam 38 at various vertical positions and are secured to horizontal struts 46 associated with the garage door 12. In this manner, the I-post beam assembly 32 is retained immediately adjacent to the garage door 12 so that the garage door is allowed to flex slightly as the wind load is transferred to the beam 38. As a result, the garage door 12 is prevented from being flexed off the guide tracks 20,22 and thus coming detached by the impact or vacuum caused by high velocity winds, thereby protecting the interior of the garage and the adjoining building structure from being damaged and/or destroyed.

Figure 2:
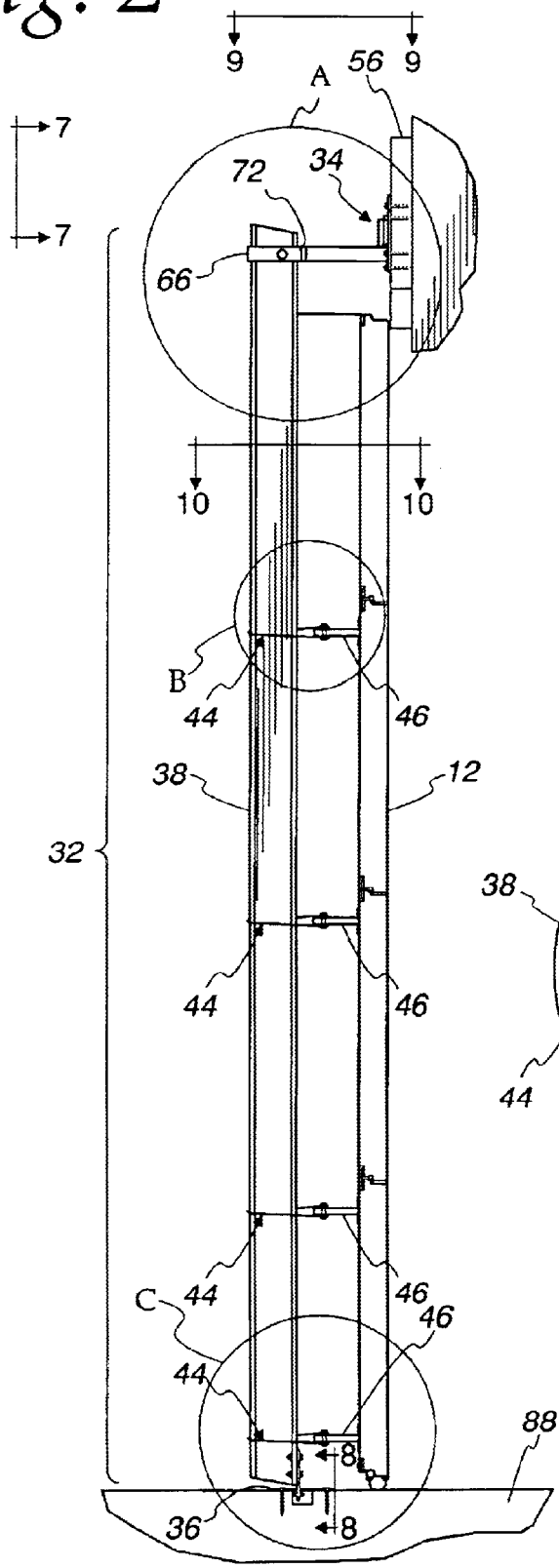
FIG. 2 is a diagrammatical side view of the garage door reinforcement arrangement, constructed in accordance with the principles of the present invention.
Figure 5:
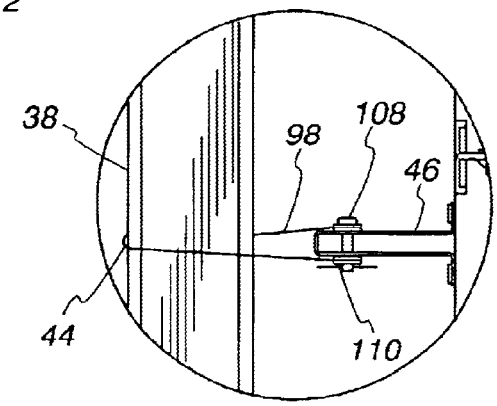
FIG. 5 is an enlarged view of the encircled portion B of FIG. 2, illustrating the engagement of one of the cable assemblies with a horizontal strut of the garage door.
Figure 3:
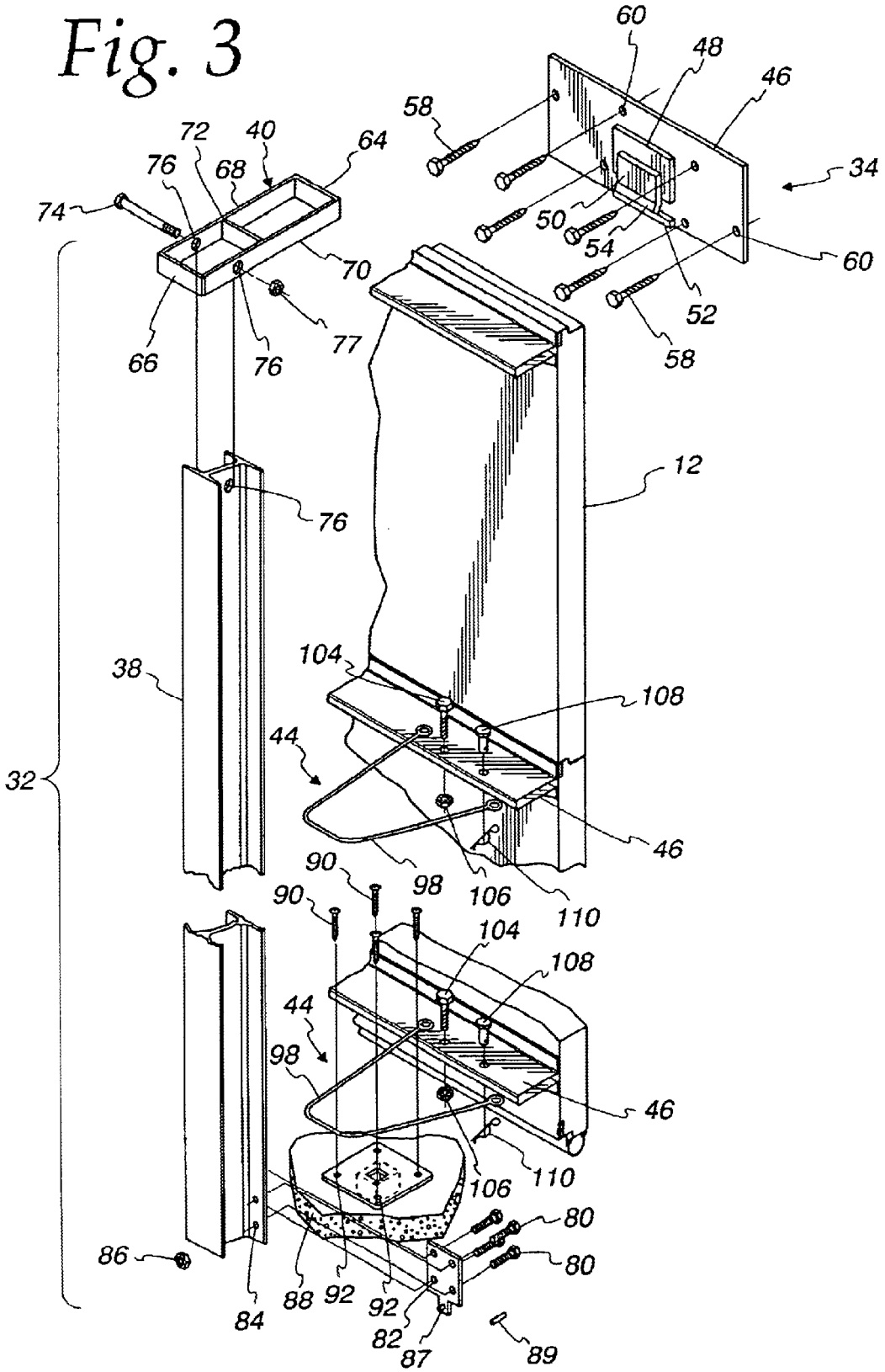
FIG. 3 is a diagrammatical exploded perspective view of the garage door reinforcement arrangement in accordance with the present invention.

As shown in FIGS. 2 and 3, the I-post beam 38 is preferably made of aluminum and has a typical length of eight and a half feet. However, it should be apparent to those skilled in the art that the length may be made to be longer or shorter in order to accommodate varying heights of garage door openings. The feature of the beam being of an I-post configuration significantly increases the amount of wind loads that it can withstand due to its symmetrical structural shape.

Figure 4:
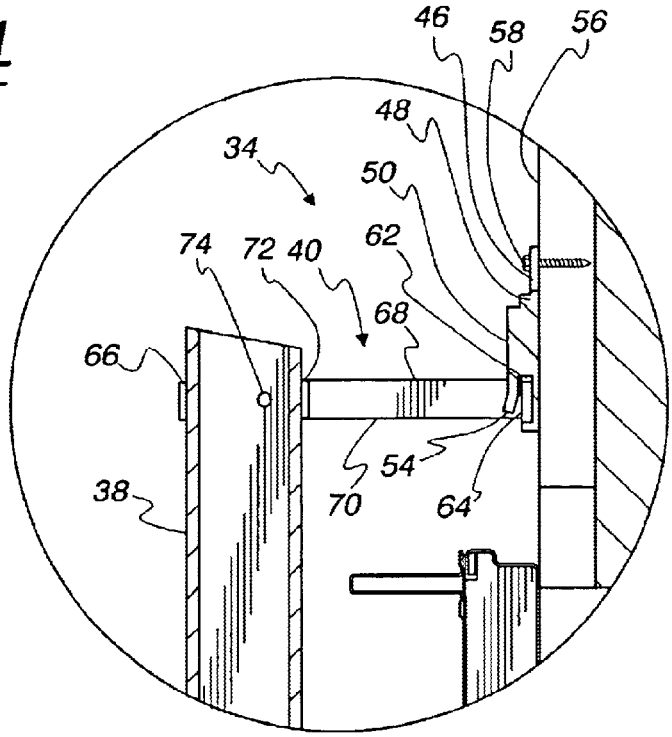
FIG. 4 is an enlarged view of the encircled portion A of FIG. 2, illustrating the engagement of the top link of the I-post beam assembly with the top mounting bracket.
Figure 7:
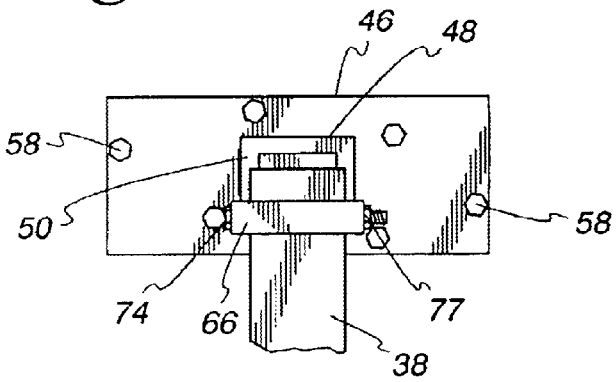
FIG. 7 is a view taken along the lines 7—7 of FIG. 2.

In FIGS. 3, 4 and 7, the top mounting bracket 34 includes a rectangularly-shaped base member 46, an intermediate member 48 secured (such as by welding) to the central portion of the base member 48, an extending portion 50 secured to the intermediate member 48, and a protruding portion 52 secured to the base member and aligned below the tip 54 of the extending portion 50. The protruding portion 50 is preferably formed as a socket head set screw which is threaded into the base member 46. The top mounting bracket 34 is preferably formed of galvanized steel and is fastened to the garage wall structure 56 by means of a plurality of lag screws 58. The lag screws 58 are inserted through corresponding holes 60 formed in the base member 46 of the mounting bracket and are then threaded into the garage wall structure 56.

The tip 54 of the extending portion 50 is spaced outwardly from the base member 46 so as to form a recess 62 therebetween. The recess 62 and the protruding portion 52 are dimensioned so as to receive and retain the distal end wall piece 64 of the top link 40 affixed to the top end of the beam 38. As can best be seen from FIGS. 3 and 9, the top link 40 is formed of two end wall pieces 64, 66 and two sidewall pieces 68, 70 which are secured together such as by welding into a rectangularly-shaped linkage. A cross piece 72 is affixed between the two side end wall pieces 68, 70 at a predetermined distance from the end wall piece 66 so as to accommodate and receive the beam 38 therebetween. The linkage is loosely retained to the top end of the beam 38 by means of a bolt 74 which is passed through holes 76 in the two side end pieces 68,70 and the beam 38 and a nut 77 which is threaded onto the end of the bolt 74. The top link is preferably formed of galvanized steel.

Figure 6:
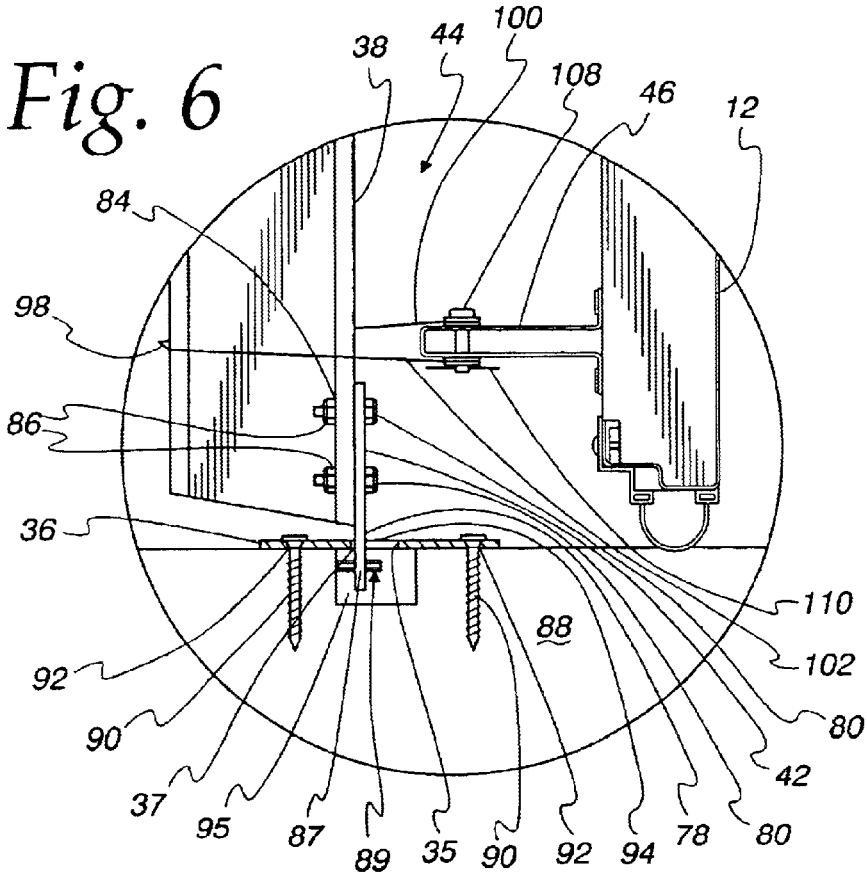
FIG. 6 is an enlarged view of the encircled portion C of FIG. 2, illustrating the engagement of the bottom catch plate of the I-post beam assembly with the floor plate.
Figure 8:
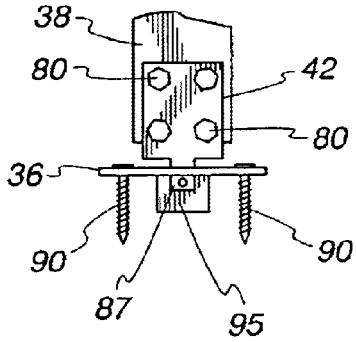
FIG. 8 is a view taken along the lines 8—8 of FIG. 2.
Figure 9:
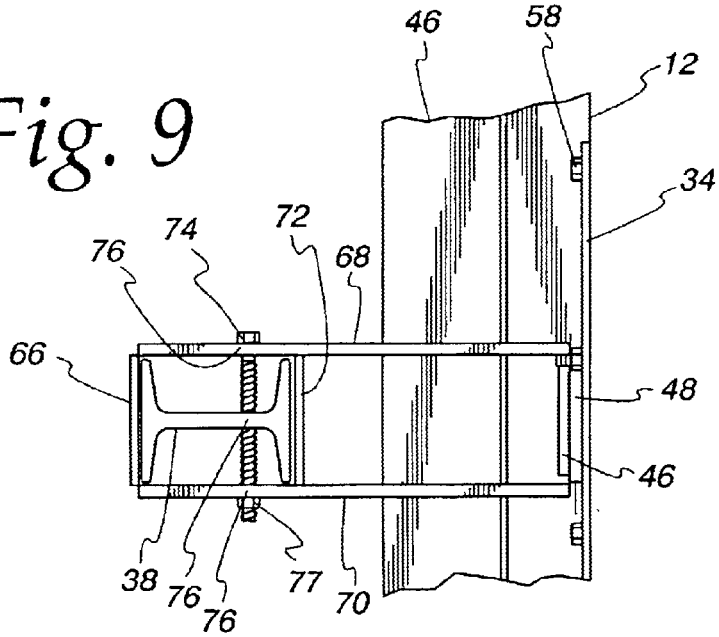
FIG. 9 is a view taken along the lines 9—9 of FIG. 2.
Figure 10:
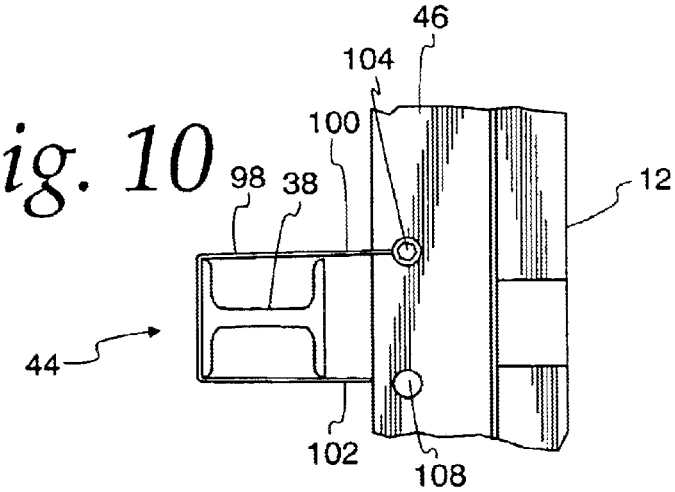
FIG. 10 is a view taken along the lines 10—10 of FIG. 2.

With reference now to FIGS. 3, 6 and 8, the bottom catch plate 42 has a generally flat, square shape and includes a downwardly-extending projection or tooth portion 78 which extends integrally from its bottom edge. The bottom catch plate 42 is securely clamped adjacent to the bottom end of the beam 38 by means of bolts 80 which are passed through corresponding holes 82 in the bottom catch plate 42 and then through openings 84 in the bottom end of the beam 38. Lock nuts 86 are threaded onto the threaded ends of the corresponding bolts 80 so as to clamp securely the catch plate 42 adjacent to the bottom end of the beam 38. The catch plate is formed preferably of steel. The tooth portion 78 has a central threaded through-hole 87 which receives a threaded pin 89 therein. It will be noted that the floor plate 36, which is of a flat square shape, is anchored to the concrete garage floor 88 by concrete fasteners 90 such as tapcon screws which are passed through holes 92 in the floor plate 36. The floor plate 36 is provided with a central rectangularly-shaped retaining slot 94 for suitably receiving the tooth portion 78 of the catch plate 42 with the threaded pin 89, as will be explained more fully below. The floor plate 36 is also preferably made of galvanized steel.

With reference again to FIG. 1, the top mounting bracket 34 can be seen to be generally affixed centrally on the inside wall surface of the garage building structure 56 between the side edges of the door opening. The floor plate 36 is anchored to the garage floor 88 and is aligned directly beneath the top mounting bracket 34. The I-post beam assembly 32 is removably installed or engaged by first placing the same in the angled orientation illustrated in FIG. 1 and inserting the distal end wall piece 64 of the top link 40 into the upper portion of the recess 62 in the top mounting bracket 34. In this position, the distal end wall piece 64 will be captured between the extending portion 50 and the base member 46 of the top mounting bracket but will not be engaged with the protruding portion 52. Next, the beam assembly 32 is rotated or moved inwardly towards the vertical orientation while pushing up so that the threaded pin 89 of the bottom catch plate 36 can be aligned and directed into the retaining slot 94 of the floor plate 36 by lowering the beam assembly 32.

When the threaded pin 89 of the bottom catch plate 36 is aligned accurately relative to the retaining slot 94, the beam assembly 32 is moved downwardly so that the threaded pin 89 becomes disposed within a garage floor opening 95 underneath the floor plate 36. At this same time, the distal end wall piece 64 will move downward slightly so as to become captured by the protruding portion 52, as illustrated in FIG. 4. In this manner, the beam assembly 32 is placed into a vertical position shown in FIG. 11 in which the top link 40 of the beam assembly 32 is operatively engaged with the top mounting bracket 34, and the bottom plate 42 of the beam assembly 32 is operatively engaged with the floor plate 36. As will be noted, the beam assembly 32 comes to rest directly against or at a slightly spaced apart distance from the horizontal struts 46 of the garage door. Thus, it can be seen that the beam assembly 32 is easily installed without use of any tools.

Next, as further shown in FIGS. 2, 5, 6 and 10, the plurality of cable assemblies 44 are affixed around the beam assembly 32 at various vertical positions and securely mounted to the corresponding horizontal struts 46 so as to allow the garage door to flex slightly as wind loads are transferred to the beam 38. Each of the cable assemblies 44 includes a galvanized aircraft cable 98 having a first end 100 and a second end 102. The first end 100 is fixedly attached to the horizontal strut 46 by fastening members 104, 106 (e.g., a threaded bolt 104 and a threaded lock nut 106). The second end 102 is fixedly attached to the strut 46 by fastener means 108, 110 (e.g., a clevis pin 108 and a hitch or hair pin 110). As a result, during high velocity winds, the garage door reinforcing arrangement 10 of the present invention prevents the door from being flexed off the guide tracks and becoming detached.

Alternatively, it will be understood by those skilled in the art that the I-beam 38 shown in FIG. 6 can be mounted in a position rotated 180 degrees around a vertical axis parallel to the garage door 12. In this latter case, the bottom catch plate 42 will be joined to the side of the I-beam 38 which is the farthest away from the side of the garage door 12 rather than being mounted on the side of the beam which is the closest to the door, as depicted in FIG. 6. As a result, the concrete fasteners 90 for the floor plate 36 will be easily accessible without interference from the lowermost horizontal strut 46 on the door 12.

It should be understood that as the garage door 12 is subjected to positive-pressure wind loads it will be pushed inwardly. In this case, a first end of the threaded pin 89 will be forced underneath the front edge 35 of the floor plate 36 so as to prevent vertical movement of the beam 32. Also, when the garage door 12 is subjected to negative-pressure wind loads it will be pulled outwardly. In this instance, the second end of the threaded pin 89 will be forced underneath the rear edge 37 of the floor plate 36 so as to again prevent vertical movement of the beam 38, as illustrated in FIG. 6.

From the foregoing detailed description, it can thus be seen that the present invention provides an improved garage door reinforcement arrangement which includes an I-post beam assembly for supporting and anchoring a garage door from being detached during a hurricane or high velocity wind conditions. The I-post beam assembly includes an I-post beam having a top end and a bottom end. A top mounting bracket is used to secure the top end of the I-post beam against vertical movement. A floor plate is used for securing the bottom end of the I-post beam against vertical movement. A plurality of cable assemblies are disposed at different vertical positions of the I-post beam for securing the beam immediately adjacent to the garage door so that the garage door is allowed to flex slightly as wind loads are transferred to the beam.

What is claimed is:

1. A garage door reinforcement arrangement for supporting and anchoring a garage door to a garage door opening, said reinforcement arrangement comprising:

an I-post beam assembly consisting of an I-post beam having a top end and a bottom end, a top link secured adjacent to the top end, and a bottom catch plate secured adjacent to the bottom end;

said top link including a first end wall piece, two sidewall pieces and a second distal end wall piece which are all secured together to form a rectangularly-shaped linkage, said top link further including a cross piece affixed between said two sidewall pieces at a predetermined distance from said first end wall piece so as to receive and loosely retain the top end of said I-post beam therebetween;

said bottom catch plate having a downwardly-extending tooth portion, said tooth portion being formed with a central through-hole for receiving a threaded pin therein;

a top mounting bracket adapted to be mounted centrally on a wall surface of a garage building structure between side edges of the garage door opening, said top mounting bracket consisting of a base member, an intermediate member secured to the base member, an extending portion secured to the intermediate member, and a protruding portion secured to said base member and aligned below a tip end of the extending portion;

said tip end of the extending portion being spaced outwardly from the base member so as to form a recess therebetween, said second distal end wall piece of the top link being received in the recess and retained by the protruding portion of the top mounting bracket;

a floor plate adapted to be anchored to a garage floor and aligned directly beneath said top mounting bracket, said floor plate including a retaining slot for receiving and retaining the tooth portion with the threaded pin of said bottom catch plate; and a plurality of cable assemblies disposed at different vertical positions of the I-post beam and adapted to be securely mounted to corresponding horizontal struts of the garage door.

2. A reinforcement arrangement as claimed in claim 1, wherein said I-post beam is made of aluminum.

3. A reinforcement arrangement as claimed in claim 1, wherein said top mounting bracket is made of galvanized steel.

4. A reinforcement arrangement as claimed in claim 1, wherein the base member of said top mounting bracket is adapted to be fastened to the wall surface of the garage building structure by a plurality of lag screws.

5. A reinforcement arrangement as claimed in claim 1, wherein said top link is made of galvanized steel.

6. A reinforcement arrangement as claimed in claim 1, wherein said bottom catch plate is made of steel.

7. A reinforcement arrangement as claimed in claim 1, wherein said catch plate is mounted adjacent to the bottom end of the I-post beam by a plurality of bolts and nuts.

8. A reinforcement arrangement as claimed in claim 1, wherein each of the plurality of cable assemblies includes a galvanized aircraft cable having a first end and a second end, said first end of each cable assembly adapted to be connected to one of the corresponding horizontal struts by a threaded bolt and a threaded nut, said second end of the cable assemblies adapted to be connected to said one of the corresponding horizontal struts by a clevis pin and a hitch pin.

9. A garage door reinforcement arrangement for supporting and anchoring a garage door to a garage door opening, said reinforcement arrangement comprising:

supporting means including an I-post beam having a top end and a bottom end, a top link secured adjacent to the top end, and a bottom catch plate secured adjacent to the bottom end;

said top link including a first end wall piece, two sidewall pieces and a second distal end wall piece which are all secured together to form a rectangularly-shaped linkage, said top link further including a cross piece affixed between said two sidewall pieces at a predetermined distance from said first end wall piece so as to receive and loosely retain the top end of said I-post beam therebetween;

said bottom catch plate having a downwardly-extending tooth portion, said tooth portion being formed with a central through-hole for receiving a threaded pin therein;

a top mounting bracket adapted to be mounted centrally on a wall surface of a garage building structure between side edges of the garage door opening, said top mounting bracket consisting of a base member, an intermediate member secured to the base member, an extending portion secured to the intermediate member, and a protruding portion secured to said base member and aligned below a tip end of the extending portion;

said tip end of the extending portion being spaced outwardly from the base member so as to form a recess therebetween, said second distal end wall piece of the top link being received in the recess and retained by the protruding portion of the top mounting bracket;

a floor plate adapted to be anchored to a garage floor and aligned directly beneath said top mounting bracket, said floor plate including a retaining slot for receiving and retaining the tooth portion with the threaded pin of said bottom catch plate; and cables disposed at different vertical positions of the I-post beam and adapted to be securely mounted to corresponding horizontal struts of the garage door.

10. A reinforcement arrangement as claimed in claim 9; wherein said I-post beam is made of aluminum.

11. A reinforcement arrangement as claimed in claim 9, wherein said top mounting bracket is made of galvanized steel.

12. A reinforcement arrangement as claimed in claim 9, wherein said top link is made of galvanized steel.

13. A reinforcement arrangement as claimed in claim 9, wherein said bottom catch plate is made of steel.

* * * * *